United States Patent [19]

Crittenden et al.

[11] 4,289,175

[45] Sep. 15, 1981

[54] TENSION SENSING MECHANISM FOR POWER-OPERATED PUSH-TYPE STRAPPING AND SEALING TOOL

[75] Inventors: David E. Crittenden, Hoffman Estates; Barry R. Angarola, Schaumburg; Robert J. Nix, Park Ridge; William A. Meier, Hoffman Estates, all of Ill.

[73] Assignee: Signode Corporation, Glenview, Ill.

[21] Appl. No.: 93,386

[22] Filed: Nov. 13, 1979

[51] Int. Cl.[3] ..... B65B 13/22; B65B 13/34

[52] U.S. Cl. ..... 140/93.4; 140/123.6

[58] Field of Search ..... 140/93.2, 93.4, 123.6, 140/123.5

[56] References Cited

U.S. PATENT DOCUMENTS

| | | | |
|---|---|---|---|
| 3,198,218 | 8/1965 | Ericsson et al. | 140/93.4 |
| 3,329,178 | 7/1967 | Plunkett | 140/93.4 |
| 3,844,317 | 10/1974 | Angarola | 140/93.2 |

*Primary Examiner*—Joseph H. McGlynn

*Assistant Examiner*—K. J. Ramsey

*Attorney, Agent, or Firm*—Dressler, Goldsmith, Shore, Sutker & Milnamow, Ltd.

[57] ABSTRACT

A strapping tool for tensioning a strap loop around an article and for crimping or notching a push-type seal around the overlapping strap portions is provided with a frame, an arm pivotally mounted on the frame for pivoting movement in a first direction and in a second, opposite direction, an abutment nose on the arm for engaging the seal during tensioning, a spring biasing the arm in the first direction during tensioning, a motor-driven tension wheel for pulling one of the overlapping strap portions through the seal to tension the loop whereby the tension reaction urges the abutment nose against the seal and, at a predetermined tension level, causes the arm to overcome the spring and pivot relative to the frame in the second direction. A jaw assembly is provided for crimping or notching the seal and a control means is provided for actuating the jaw assembly in response to the movement of the arm in the second direction at the predetermined tension level.

10 Claims, 12 Drawing Figures

Fig. 12.

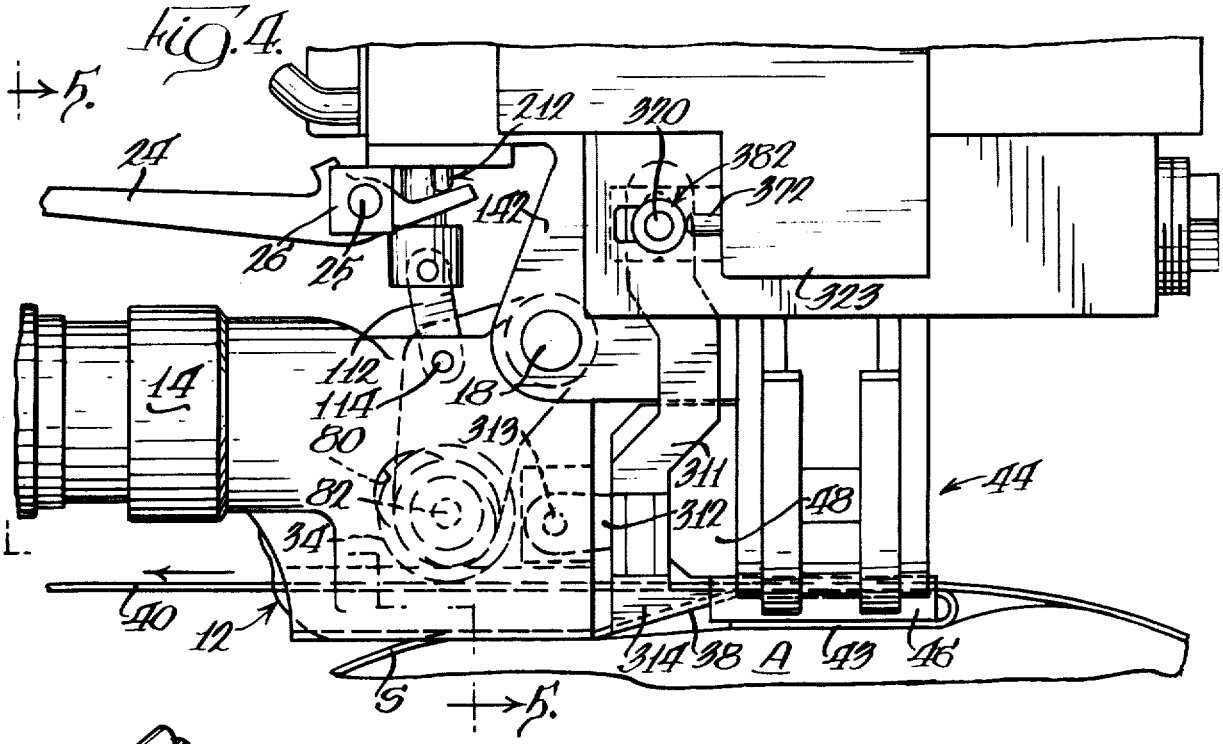
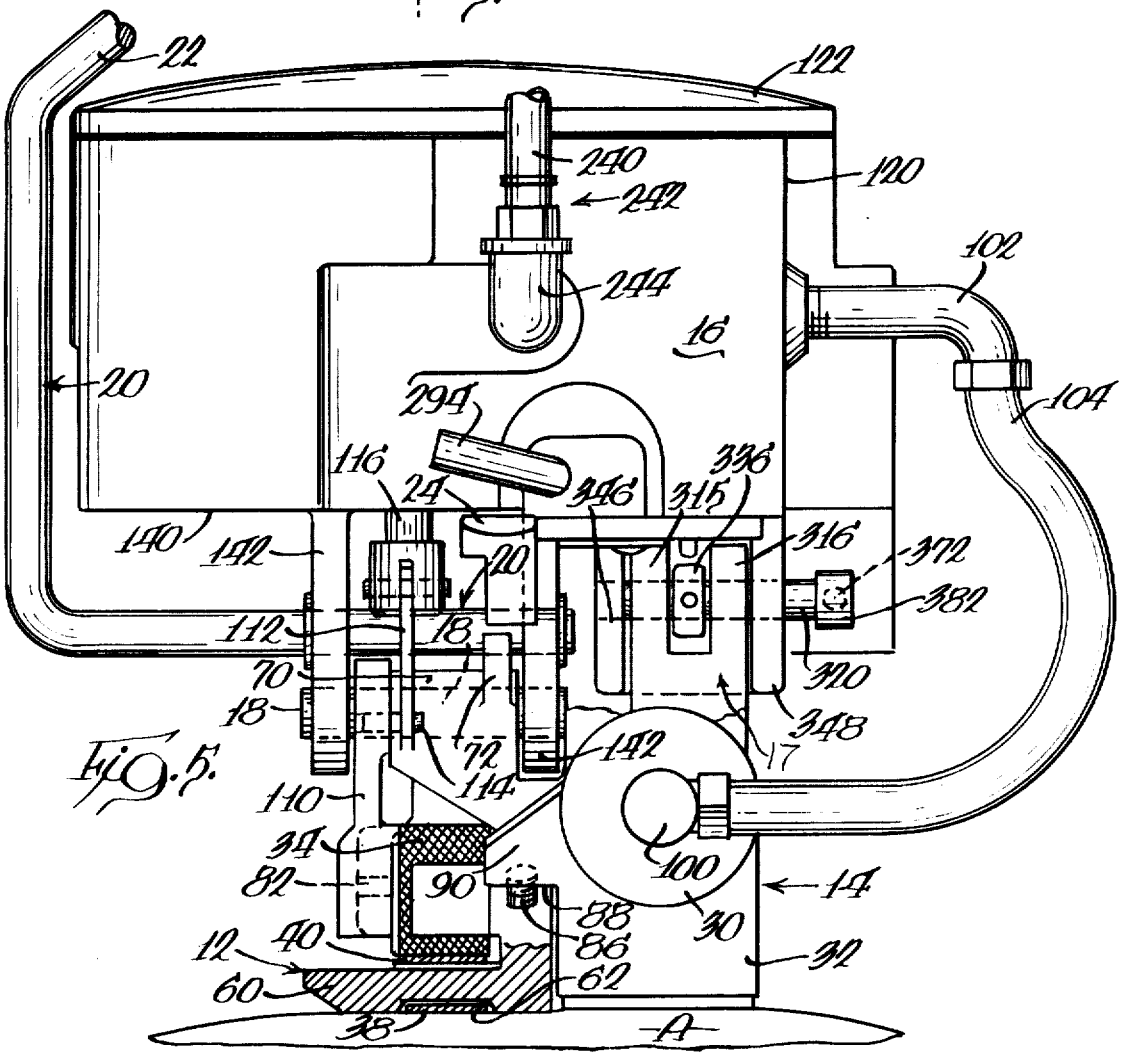
Fig. 5.

STRAP RELEASE SEQUENCE

TENSIONING SEQUENCE

SEALING SEQUENCE

TENSION SENSING MECHANISM FOR POWER-OPERATED PUSH-TYPE STRAPPING AND SEALING TOOL

DESCRIPTION

Technical Field

This invention relates to power-operated, self contained strapping tools for constricting and tensioning a loop of strapping about an article and for then sealing the tensioned loop tightly about the article.

In particular, this invention relates to a so-called push-type strapping tool, preferably pneumatically operable, which tensions a loop of strapping about an article where the loop has overlapping free end and trailing end portions threaded through a generally tubular or sleeved seal having overlapping or adjacent flanges and where the strap free end is doubled over and restrained between the seal and the article during tensioning. After the tensioning sequence is completed, the tool crimps or notches the seal about the overlapping strap portions to form a secure joint and severs the trailing portion of strap from the loop.

BACKGROUND OF THE INVENTION

Push-type strapping tools are known which achieve tension by pushing against a seal which has been threaded on overlapping strap portions with the free end of the strap bent back under the seal. A manually operated tool of this type is disclosed in the U.S. Pat. No. 3,844,317 to Angarola et al. A power-operated type of tool which automatically tensions and subsequently crimps or notches the seal is marketed by Brainard Strapping Division, NVF Corporation under the designation PNRDPA.

Another type of power-operated, push-type tool, which is pneumatically-operated, is disclosed in the U.S. Pat. No. 3,329,178 to Plunkett. The tool disclosed in the Plunkett patent is actuated by the tool user or operator to tension the loop about the article and is then subsequently actuated a second time by the operator to crimp the seal around the overlapping strap segments.

In some applications, particularly those involving thermally hot articles such as coils or hot steel, it would be desirable to have a push-type strapping tool that need by activated only once by manually operating a switch or lever so that the tool then automatically tensions the strap loop, crimps or notches the seal about the overlapping strap portions, severs the trailing portion of the strap from the tensioned and sealed loop, and then retracts the mechanisms as may be necessary to permit the tool to be removed from the tensioned strap loop. A tool which would automatically effect the various operations would be safer under such conditions because the operator of the tool could move away from a hazardous environment while the tool is cycling. The tool would be more efficient because the operator could perform other tasks while the tool is cycling.

The above-described Brainard Strapping Division PNRDPA tool automatically initiates the various sequences, and in particular, automatically initiates the sealing sequence upon sensing the pressure rise in the air line to an air motor. It would be desirable to provide a tool in which a predetermined tension level could be positively sensed by the movement of a member, which movement would be directly effected by the tension in the strap acting through a rigid engagement of the member with the strap seal. It would also be beneficial to provide a means that could be easily adjusted to vary the predetermined tension level at which the tool would initiate the sealing sequence.

SUMMARY OF THE INVENTION

A novel tensioning sensing mechanism and control system is provided for a push-type strapping tool.

The tool has a frame adapted to rest upon the article around which strap is looped both overlapping strap portions threaded through a crimpable seal and with the strap free end doubled over and restrained between the seal and the article. An arm is pivotably mounted on the frame for pivoting movement in a first direction and in a second, opposite direction. An abutment means is provided at one end of the arm for engaging the seal during tensioning. It is through this abutment means that the seal is "pushed" by the tool during tensioning.

The tool is further provided with (1) a means for biasing the arm in the first direction during tensioning and with (2) a tensioning means mounted on the frame for engaging one of the overlapping portions of the strap and for pulling the strap through the seal to tension the loop. The tension reaction on the tool urges the frame relative to the seal to force the arm abutment means against the seal and, at a predetermined loop tension level, causes the arm to overcome the biasing means and pivot relative to the frame in the second direction.

Jaws are provided for crimping or notching the seal around the overlapping portions of the strap after the loop has been tensioned. To this end, a novel control means responsive to the pivoting movement of the arm in the second direction is provided for operating the crimping means.

The strapping tool with the novel tension sensing mechanism of the present invention is unaffected by small pressure differentials when used with an air-operated tensioning motor as a tensioning means. The pressure of the air supply to the tool can be set at any value between the minimum required for adequate crimping of the seal and the maximum design pressure for the parts of the tool that may be subjected to such air pressure. The tension level at which the jaws are actuated to crimp the seal can be easily adjusted by using an adjustable spring assembly as the biasing means on the pivotably mounted arm. The tensioning action of the tensioning motor need not be, and is not, terminated during the sealing sequence.

With such a novel tension sensing mechanism, the pivotable arm moves the same distance every cycle and thus the repeatability of the tool with respect to producing a predetermined tension level is very good.

Since the novel tension sensing mechanism of the present invention does not rely upon the stalling of a tensioning air motor, there is no variable time delay which can occur in such systems where the sealer must be activated in response to sensing a pressure rise when the air motor stalls.

The novel combination of elements in accordance with the present invention yields desirable and beneficial results—results which are not only new and different, but which also provide a substantial improvement over the prior art.

Numerous other advantages and features of the present invention will become readily apparent from the following detailed description of the invention and of one embodiment thereof, from the claims and from the accompanying drawings.

BRIEF DESCRIPTION OF THE DRAWINGS

In the accompanying drawings forming part of the specification and in which like numerals are employed to designate like parts throughout the same.

FIG. 4 is a view similar to FIG. 2 but showing the tool engaging the seal during the tensioning of the strap loop;

FIG. 5 is an end view, partially in cross-section, of the tool taken generally along the plane 5—5 in FIG. 4;

DESCRIPTION OF THE PREFERRED EMBODIMENT

This invention may be used in many different forms. This specification and the accompanying drawings disclose only one specific form as an example of the use of the invention. The invention is not intended to be limited to the embodiment illustrated, and the scope of the invention will be pointed out in the appended claims.

The precise shapes and sizes of the components herein described are not essential to the invention unless otherwise indicated, since the invention is described with reference to an embodiment which is simple and straightforward.

For ease of description, the apparatus of this invention will be described in a normal operating position and terms such as upper, lower, horizontal, etc., will be used with reference to this normal operating position. It will be understood, however, that the apparatus of this invention may be manufactured, stored, transported and sold in an orientation other than the normal operating position described.

The apparatus of this invention has certain conventional drive mechanisms and control mechanisms the details of which, though not fully illustrated or described, will be apparent to those having skill in the art and an understanding of the necessary functions of such mechanisms.

Figures 1, 1A:
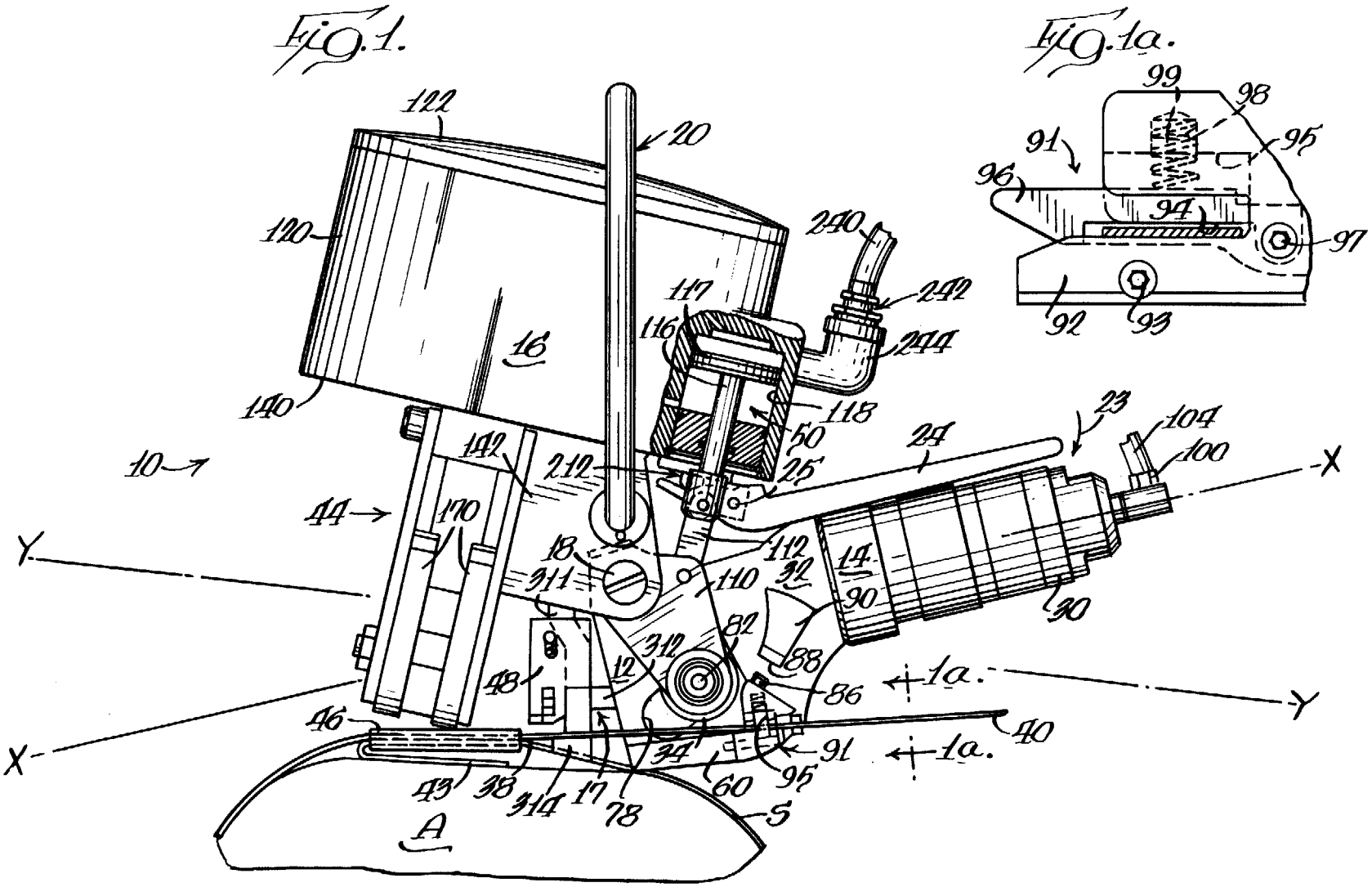
FIG. 1 is a side elevational view, partly in section, of a pneumatic strapping tool embodying the principles of the present invention, the tool being illustrated with the operative parts thereof in the position which they assume when air is first supplied to the tool and the latter is in condition for immediate use to tension a loop of strap S around an article A.
FIG. 1*a* is an enlarged fragmentary end view taken substantially along the plane 1*a*—1*a* in FIG. 1.

Referring now to the drawings in detail and in particular to FIG. 1, a pneumatic strapping tool constructed in accordance with the principles of the present invention has been designated in its entirety at 10.

The novel mechanisms of the present invention, in the embodiment illustrated, are specially adapted for use with, and are incorporated in, a modification of a strapping tool illustrated and described in the abovementioned U.S. Pat. No. 3,329,178 to Plunkett. Hence, some of the mechanisms of the strapping tool 10 are identical to those described in the Plunkett patent and operate in the same manner. Such mechanisms include the tensioning motor and tension wheel for drawing the strap loop tight about the article to be bound, the piston and cylinder unit associated with the tensioning assembly for moving the tension assembly into position on the article, the seal-retaining and seal-crimping unit, and the strap-shearing device which is effective to shear the strap in the immediate vicinity of the seal after the seal has been crimped about the overlapping strap segments. These various mechanisms will be described in only so much detail as is necessary for a complete understanding of the novel mechanisms of the present invention and reference is directed to the Plunkett patent for a more complete description of the conventional mechanisms.

Briefly, the strapping tool 10 involves in its general organization four relatively movable frame assemblies including a main frame or foot assembly 12, a strap tensioning assembly 14, a sealing assembly 16 and tension sensing mechanism 17. The first three assemblies are pivoted for limited relative swinging movement about a common horizontal axis represented by the pivot pin or shaft 18. The tension sensing mechanism is pivotally supported from foot assembly 12.

A suspension rod 20 pivoted to the sealing assembly 16 extends upwardly along one side of the tool and has an arched portion (FIG. 5) shown at 22 which is adapted to overlie the tool for supporting the same bodily from a suitable overhead hoist or support when the tool is not in operation. The rod 20 also serves as the carrying handle for the tool. When the tool is thus supported, the rod 20 extends substantially vertically as shown in full lines in FIG. 1, and, since the point of pivotal support of the tool on the rod coincides substantially with the center of gravity of the tool, the latter possesses a degree of stable equilibrium in any suspended position of the tool.

When the tool is lowered upon an article undergoing strapping, the tool is supported on the foot assembly 12 in the manner and for a purpose that will be described presently. The tool is capable of being used in other positions as more fully described in the aforementioned U.S. Pat. No. 3,329,178 to Plunkett.

When the tool is suspended from the rod 20 as shown in FIG. 1 and is in its free state, i.e., before it is connected to a source of air, the four assemblies 12, 14, 16 and 17 assume relative positions which, in the normal operation of the tool, do not occur. As soon as the tool is supplied with air, certain valve-control piston movements are set into operation which results in movement of the parts to positions in which they are shown in FIG. 1. Thereafter, operation of the tool for article strapping purposes upon the actuation of a manually operable lever 24 and in the manner that will be described in detail presently, effects other positional relationships of the parts whereby strap clamping, strap tensioning, seal positioning, seal crimping or notching, strap severing and strap releasing operations occur automatically and progressively in the order named. Since the abnormal positions of the four assemblies 12, 14, 16, and 17, as well as of the operative piston and valve control devices and other instrumentalities associated therewith, do not occur in the operations of the tool and otherwise perform no useful functions, they will not be described herein and reference will be made only to the operative positions of the parts.

The strap tensioning assembly 14 has associated therewith a pneumatically operated motor 30 which is operatively connected through a gear reduction device 32 to a rotatable strap tensioning or feedwheel 34. This wheel 34 is designed for cooperation with an anvil portion 60 on the foot assembly 12 to clamp the trailing end portion 40 of the strap S therebetween and to draw the strap taut about the article A undergoing strapping.

In FIG. 1, the manner in which the strap S is applied to the article A and caused to pass between the tension wheel 34 and the anvil 60 is clearly illustrated. The tool 10 is lowered into the vicinity of the article A and the strap S is then passed through a sleeved or tubular seal 46 and around the article A with its leading end region 38 also passing through the seal 46. The trailing end region 40 for the strap overlaps the leading end region 38 of the strap in the seal 46 and then passes rearwardly between the tensioning wheel 34 and anvil 60. The extreme strap end portion, or free end 43, is turned rearwardly so that it underlies the seal 46.

During the tensioning operation, the underlying free end portion 43 of the strap S is thus retained between the seal 46 and the article A and prevents the strap from being pulled out of the seal 46.

The sealing assembly 16 has associated therewith a seal retaining and crimping or notching unit 44 which is effected during the tensioning operation to engage and retain a previously applied seal 46 in encircling relationship about the overlapping portions 38 and 40 of the strap loop. Subsequently, and after a predetermined degree of tension has been attained in the strap loop, the unit 44 is effected to crimp or notch the seal 46 about the overlapping portions. The seal crimping or notching unit 44 may be of any conventional design and is illustrated here as being a pneumatically operated jaw assembly which is described in detail in the aforementioned U.S. Pat. No. 3,329,178 to Plunkett and reference is directed thereto. The jaw assembly may crimp the seal or may notch the seal. Though the word "crimp" is generally used throughout this description, it is to be understood that the invention includes other forms of securing a seal around the straps, such as by notching.

As described in detail in the Plunkett patent, after the tool has been supplied with air under operating pressure, the strap tensioning assembly 14 will assume a raised position wherein its longitudinal axis is coincident with the line X—X of FIG. 1. At this time, the tensioning wheel 34 will assume a retracted position remoted from the anvil 60 so that when the tool is lowered to bring the foot assembly 12 into contact with the article A, the trailing end portion 40 of the strap may be introduced sidewise between the tensioning wheel 34 and the anvil 60.

Depression of the operating lever 24 causes the motor 30 to rotate the tension wheel 34 and actuates a piston and cylinder unier 50 carried by the sealing assembly 16 to move the tensioning assembly 14 bodily as a unit to a lowered position wherein its longitudinal axis is coincident with the line Y—Y of FIG. 1. In this position, the strap is engaged between the rotating tensioning wheel 34 and anvil 60. At the same time the tensioning assembly 14 is lowered, the foot assembly 12 and sealing assembly 16 become oriented in the positions shown in FIG. 2 to align the crimping unit with the seal 46.

Figure 2:
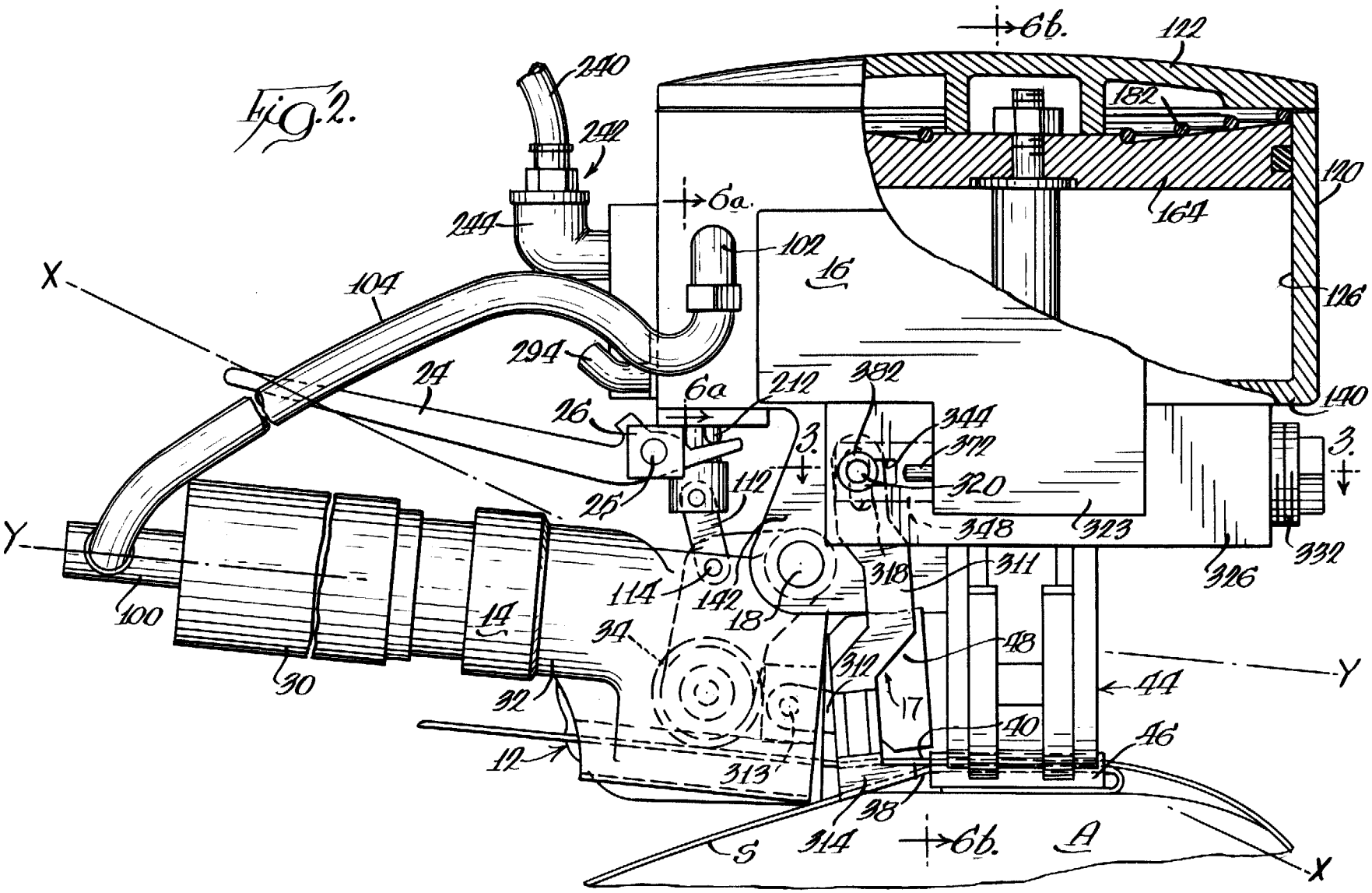
FIG. 2 is an enlarged fragmentary, elevational view, partially in section, of the side of the tool opposite that illustrated in FIG. 1, but showing the tool just beginning to tension the strap loop.

As soon as the assemblies have been thus moved to the positions wherein they are shown in FIG. 2, the tensioning wheel 34 becomes effective to tension the strap S about the article A. When the strap S has attained a predetermined degree of tension, actuation of the seal crimping unit 44 is initiated to effect the seal crimping operation.

The seal crimping operation is followed automatically by actuation of a shearing unit 48, carried by foot assembly 12, to sever the strap S in the immediate vicinity of the crimped seal 46. The shearing unit 48 and the mechanism by which it is actuated may be of a suitable conventional design, but is here illustrated as being of that construction fully described in the aforementioned Plunkett patent and reference is directed thereto.

As soon as the severing operation has been completed, the tool is automatically operable to restore the assemblies 12, 14, 16 and 17 to their original positions as shown in FIG. 1, the crimping unit 44 serving to release the seal 46, and the tensioning wheel 34 and anvil 60 serving to release the Strap S, thus freeing the tool.

THE FOOT ASSEMBLY

The foot assembly 12, although of appreciably smaller proportions than the assemblies 14 and 16, may for facility of description be regarded as the main frame of the tool 10 inasmuch as during the actual strapping operation it seats squarely upon the article A undergoing strapping and affords reaction for the movements of the other two assemblies.

The assembly 12 is comprised of a casting which is generally L-shaped in transverse cross section and which provides a laterally extending horizontal foot or anvil 60, the underneath surface of which is formed with a shallow channel 62 (FIG. 5) which guides or centers the strap S during the tensioning operation.

As best illustrated in FIG. 5, the foot casting includes a lateral boss 70 through which the pivot pin or shaft 18 extends. A raised shoulder-forming rib 72 on the boss 70 is designed for engagement with hanger rod 20 carried by the sealing assembly 16 and limits the extent of swinging movement of the sealing assembly in one direction with respect to the foot assembly 12.

As illustrated in FIG. 1, the shearing unit 48 may be removably mounted on the forward region of the tension sensing mechanism 17 and the front side of this unit 48 is engageable with the rear side of the seal-retaining and crimping unit 44 to limit the extent of swinging movement of the latter unit with respect to the foot assembly 12 in the other direction.

Swinging movements of the tensioning assembly 14 in opposite directions with respect to the foot assembly 12 are limited by the provision of an elongated clearance slot 78 (FIG. 1) formed in the foot assembly 12, one end 80 (shown in dashed line in FIG. 4) being engageable with a tensioning wheel supporting shaft 82 associated with the tensioning assembly 14 to limit the raised inoperative position of the assembly.

As illustrated in FIGS. 1 and 5 and as fully described in the aforementioned Plunkett patent, an adjustable set screw 86 opposes a downwardly facing shoulder 88 provided on a radially disposed protuberance 90 formed on the gear reduction device 32 and is designed for engagement with the shoulder 88 to prevent direct engagement between the tensioning wheel 34 and the anvil 60 when there is no strap in the tool.

As illustrated in FIGS. 1 and 1a, a strap guide and latch assembly 91 may be provided on foot 12 to retain the upper, trailing strap portion 40 on the anvil 60. A fixed strap guide 92 is mounted to anvil 60 with screw 93 and has a horizontal slot 94 for receiving the strap. A vertical slot 95 is provided in fixed guide 92 and in foot assembly 12 for receiving a cantilevered strap guide 96 which is pivotally mounted to guide 92 with screw 97. A bore 98 in foot assembly 12 is provided to receive one end of a compression spring 99 which continuously biases the pivotable guide 96 downwardly to retain the strap portion 40 in alignment on the anvil 60. To load or unload the tool 10 with the strap, the guide 96 is forced upwardly by the operator to allow insertion or removal of the strap.

In addition to the strap guide 91, or instead of strap guide 91, tool 10 may be provided with a strap-retaining detent device, as described in detail in the aforementioned Plunkett patent (illustrated therein as a detent ball 93 and projecting pin 94), to grip the strap S and to prevent the hazard of spring flexed strap in the vicinity of tool operations.

THE TENSIONING ASSEMBLY

The specific details of the pneumatically operable motor 30 and gear reduction device 32 which, in the main, constitute the tensioning assembly 14 have not been illustrated herein inasmuch as they form no part of the present invention. Any suitable type of motor, including the air-operated motor and associated gear reduction device illustrated, may be employed. These two instrumentalities are connected as described in the aforementioned Plunkett patent and are provided with an elbow fitting 100 by means of which the motor may be connected to a second elbow fitting 102 associated with the previously mentioned sealing assembly 16. A flexible conduit 104 extends between the two elbow fittings 100 and 102.

As described in detail in the aforementioned Plunkett patent, the shaft 18 constitutes the common pivotal support for the three assemblies 12, 14, and 16. Insofar as the tension assembly 14 is concerned, the upper forward region of the gear reduction device 32 fixedly receives the shaft 18 so that swinging movements of the assembly 14 are accompanied by rocking movement of shaft 18. As best illustrated in FIGS. 1 and 5, a link 110, which may be regarded as part of the tensioning assembly 14 since it moves bodily with this assembly, has its proximate end connected to the shaft 18 and its distal end connected to the shaft 82 which supports the tensioning wheel 34.

The link 110, in effect, constitutes a crank arm by means of which rocking movements of the assembly 14 on the foot assembly 12 may be effected under control of a connecting or positioning link 112. The lower end of the link 112 is connected to a pin 114 provided in the medial regions of the link 110 while the upper end of the link 112 is connected to a plunger 116 carried by a piston 117 (FIG. 1) mounted for reciprocation in a cylinder 118 of positioning assembly 50.

The positioning assembly 50 serves to effect a limited swinging movement of the link 110 to in turn cause shifting movement of the assembly 14 bodily as a unit between the lines X—X and Y—Y illustrated in FIG. 1 and as described above and in the aforementioned Plunkett patent.

THE SEALING ASSEMBLY

Figure 6:
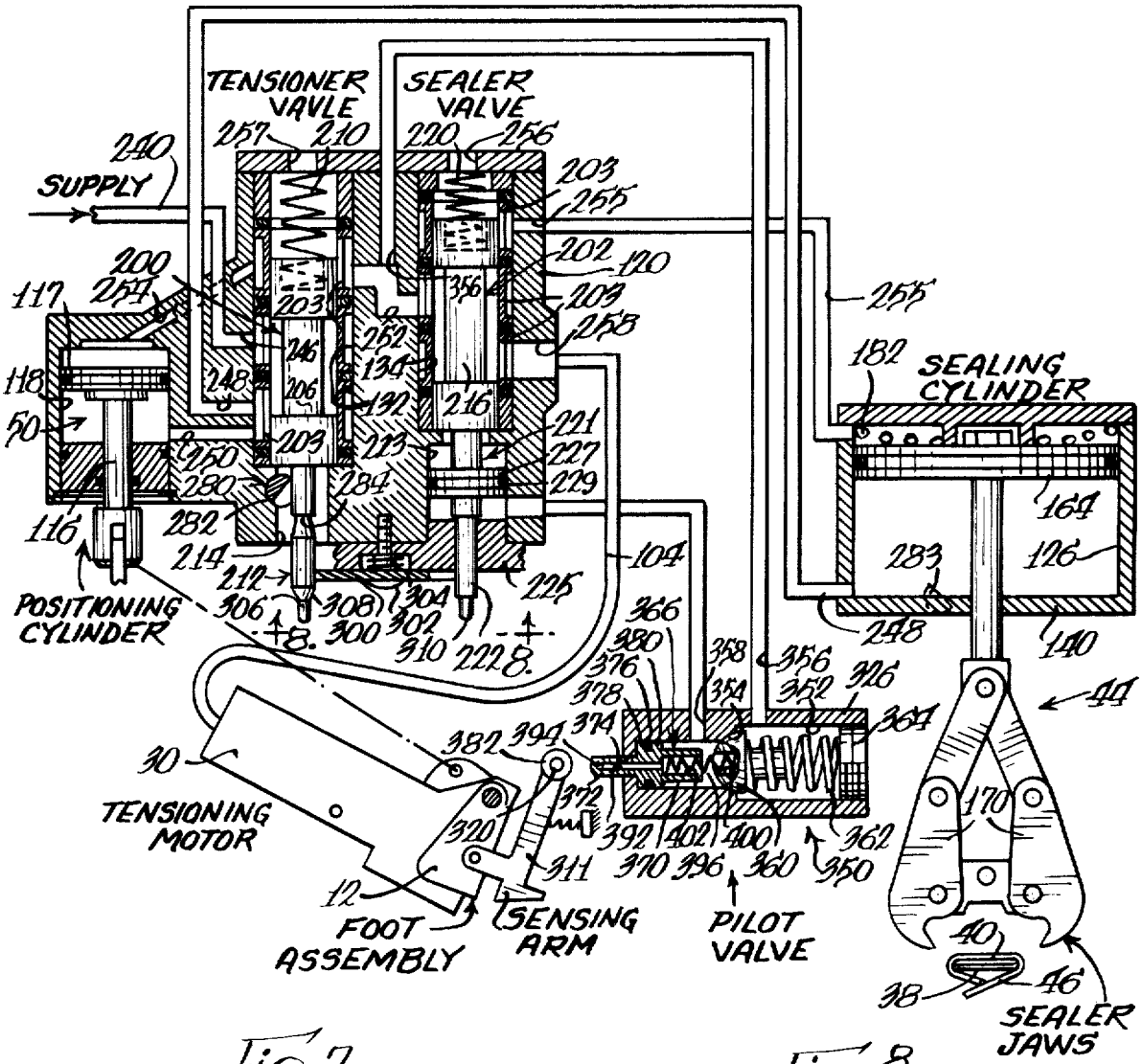
FIG. 6 is a pneumatic diagram, with the positioning piston and cylinder assembly, the tensioner valve, and the sealer valve mechanisms being shown in cross section taken generally along the plane 6*a*—6*a* in FIG. 2 and with the sealer piston and cylinder assembly shown in cross section taken generally along the plane 6*b*—6*b* in FIG. 2, the various interconnecting air passages being illustrated only diagrammatically for purposes of clarity and the positions of the various mechanisms being illustrated when air is first supplied to the tool but before the tensioning sequence has been initiated.

The sealing assembly 16 may be of more or less conventional design and a similar assembly is shown and described in the aforementioned Plunkett patent. Reference may be had to that patent for a full understanding of the nature and operation of the mechanism. For purposes of description herein, it is deemed sufficient to point out, briefly, the general organization of the sealer assembly. As best illustrated in FIGS. 1, 2, 5, and 6, the assembly has an upper cup-shaped housing 120, the upper open rim of which is closed by a closure head 122. The housing is internally compartmented to provide a cylinder 126 (FIGS. 2 and 6) as well as to provide the cylinder 118 (FIGS. 1 and 6) associated with the previously mentioned positioner piston and cylinder unit 50, and also a pair of valve chambers 132 and 134 (FIG. 6).

The housing 120 is provided with a bottom wall 140 from which there extends downwardly a pair of spaced apart ears 142 (FIG. 1), the previously mentioned pivot pin or shaft 18 extending transversely between the ears and serving as a pivotal support of the sealer assembly 16 as a whole. The suspension rod 20 also is pivotally supported by the ears 142.

The previously mentioned seal crimping unit 44 is supported from the bottom wall 140 and ears 142 of the housing 120 and includes a pair of opposing dual jaw members 170 (FIGS. 1 and 6). The jaws 170 are actuated through a suitable conventional linkage assembly by a piston 164 mounted for reciprocation in the cylinder 126. The detailed construction and operation of the jaws and linkage assembly is fully illustrated and described in the aforementioned Plunkett patent and reference is directed thereto.

As set forth in the aforementioned Plunkett patent, the strap shearing unit 48 may be arranged to cooperate with the crimping unit 44 so that the strap shearing unit 48 is operated to shear the strap along the rear edge of the strap seal 46 by the crimping unit 44 as the crimping unit 44 is completing the crimping of the seal 46 about the overlapping strap portions.

Also, as described in detail in the aforementioned Plunkett patent, cylinder 126 houses a piston 164 normally and yielding biased downwardly in the cylinder 126 by means of a helical involute compression spring 182 (FIGS. 2 and 6) so that when the lower region of the cylinder 126 is in communication with the atmosphere and no air is supplied to the upper region thereof, the piston 164 is forced downwardly solely under the influence of the spring 182, thus moving the crimping jaws 170 into holding engagement with the seal 46, but under insufficient pressure to effect the crimping operation. The seal is thus held in a position to register with the tension wheel 34 and the anvil 60 during the strap tensioning operation. Subsequently, at a point later in the tool cycle, air under full line pressure is supplied to the upper region of cylinder 126 to forcibly drive the piston 164 downwardly, thus applying full power to the crimping jaw members 170 and effecting the crimping operation.

THE TENSION SENSING MECHANISM

Figure 3:
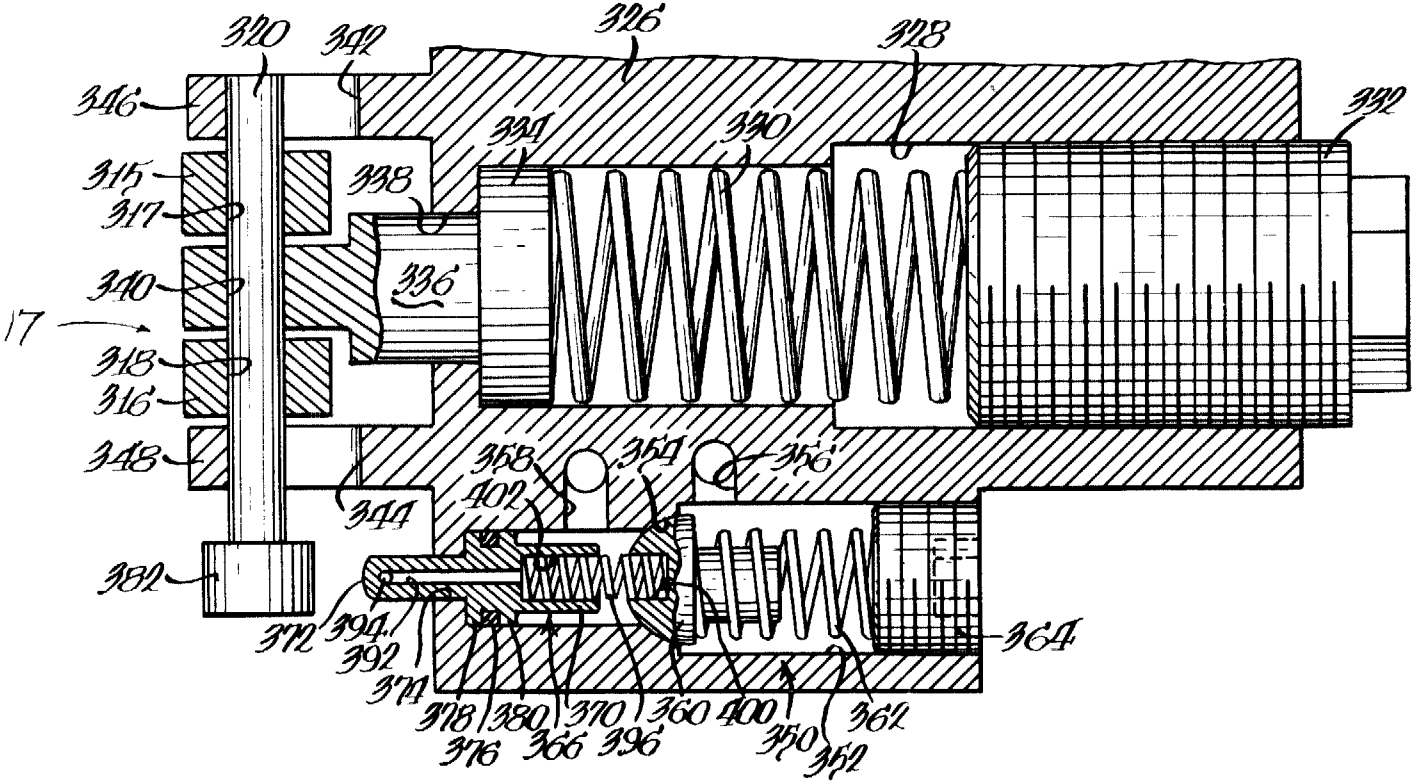
FIG. 3 is a fragmentary, cross-sectional view taken substantially along the plane 3—3 in FIG. 2 and showing the adjustable tension level setting mechanism and pilot valve.

The tension sensing mechanism 17 is best illustrated in FIGS. 2, 3 and 4 wherein a tension sensing arm 311 is shown pivotably mounted to the foot assembly 12 and guided at its upper end relative to the sealing assembly 16. Specifically, the tension spring arm 311 has a rearwardly projecting lug 312 which is pivotably mounted about a pin 313 carried in the foot assembly 12. The bottom end of arm 311 is provided with an abutment member or nose 314 which is adapted to be disposed between the upper overlapping, or trailing strap portion 40 and the lower overlapping, leading end strap portion 38 and to abut one end of the seal 46 during tensioning (the orientation during tensioning being illustrated in FIG. 4). Thus, during tensioning, the tension wheel 34 pulls the upper overlapping strap segment 40 to tighten the loop about the article A and the reaction force tends to move the tool, and specifically the frame 12, forward to urge the nose 314 tight against the seal 46.

The upper end of the tension sensing arm is bifurcated to provide members 315 and 316 as best shown in FIG. 3. Member 315 has a vertically elongated slot 317 and member 316 has a vertically elongated slot 318 through which a pin 320 is disposed.

The bottom of the sealing assembly 16 has a housing portion 326 (FIGS. 2 and 3) which defines a chamber 328 in which is disposed a compression spring 330, the compression of which can be adjusted by threaded plug 332 retained in the housing portion 326. A piston 334 is slidably received in one end of the chamber 328 and has a rod 336 projecting through a bore 338 in the housing portion 326. The piston 334 is normally biased to the end of the chamber 328 by spring 330. The distal end of rod 336 defines a bore 340 through which the pin 320 passes.

The pin 320 is guided for reciprocating horizontal movement within elongated slots 342 and 344 defined in outwardly projecting housing portions 346 and 348, respectively. Owing to the elongated nature of the slots 317 and 318 in the sensing arm upper members 315 and 316, respectively, the arm 311 can pivot about pin 313 in a first direction (counterclockwise as viewed in FIG. 2) and in a second, opposite direction (clockwise as viewed in FIG. 4) with the slots 317 and 318 permitting arcuate movement of the arm relative to the pin 320 which necessarily moves in only a forward or rearward direction relative to the generally horizontal slots 342 and 344 of the housing 326.

The plug 332 is normally adjusted to establish a predetermined compression force in spring 330 which is about equal to the desired final loop tension force. When the set tension force is reached, the nose 314 of arm 311 is urged by the seal 46 to cause arm 311 to pivot clockwise about the mounting shaft 313 and overcome the biasing effect of spring 330. This movement is used to actuate a pilot valve, as will next be explained, which ultimately actuates the crimping unit 44 to crimp the seal tight about the overlapping strap portions in the tensioned loop.

Also mounted in the housing portion 326 is a pilot valve 350 which serves to control, on an on-off basis, flow of pressurized air to certain control mechanisms as will be explained in more detail hereinafter. The pilot valve, illustrated in FIG. 3 and shown enlarged in FIG. 6, is disposed generally within a chamber 352 in the housing portion 326 adjacent the biasing spring 330 and pin 320. The chamber 352 has a generally frustoconical valve seat 354 downstream of which is an inlet passage 356 and upstream of which is an outlet passage 358.

A mushroom-shaped valve member 360 is disposed within chamber 352 and is adapted to be moved against the frustoconical valve seat 354 for blocking flow of air between the inlet passage 356 and the outlet passage 358. To this end, the valve member 360 is normally biased by a compression spring 362, one end of which bears against the valve member 360 and the other end of which bears against a threaded plug 364 inserted in the housing portion 326 and defining one end of the chamber 352.

A valve actuation engagement member 366 is disposed within the chamber 352 downstream of the valve member 360 and has a first generally cylindrical portion 370 and a second generally cylindrical stem portion 372. At the downstream end of the chamber 352, the housing 326 defines a bore 374 through which the stem 372 passes and in which the stem 372 is slidably disposed. Air leakage from the pilot valve is prevented by an O-ring 376 retained between two flanges, 378 and 380 on the first portion 370 of the actuation engagement member 366.

The distal end of the stem portion 372 exterior of the housing 326 is adapted to be engaged by the pin 320 when the pin is moved under the influence of the tension sensing arm 311 against the stem 372 (from the left to the right as viewed in FIG. 3). To this end, the pin 320 is preferably provided with an enlarged portion or contact wheel 382 which is positioned in alignment with the stem 372 and adapted to contact the distal end of the stem 372.

Movement of the pin 320 from the left to the right as viewed in FIG. 3 will thus cause the actuation member 366 to move to the right and force the valve member 360 away from the valve seat 354 to thus open the pilot valve and allow pressurized air to pass from the inlet passage 356 to the outlet passage 358.

When the link 320 and contact wheel 382 carried therein are moved away from the stem 372 (to the leftmost position illustrated in FIG. 3), the residual air within the chamber 352 downstream of the closed valve member 360 may be discharged through a cylindrical leak-off bore 392 in member 366 which directs air from inside the valve to the exterior of the valve through a discharge aperture 394 in the stem portion 372.

To provide access to the leak-off bore 392 from the interior of the pilot valve chamber 352, the member 366 is normally biased away from the closed valve member 360 by means of a compression spring 396 which is disposed at one end in a bore 400 in the valve member 360 and at the other end in a bore 402 in the first portion 370 of the member 366. Thus, when the valve member 360 is closed, the member 366 is biased to the extreme leftmost position in the chamber 352 and is spaced away from the valve member 360 to provide a flow path into the bore 402 and leak-off passage 392. Obviously, the spring force of spring 396 is less than the spring force of spring 362 so that whenever the pin 320 and contact wheel 382 carried thereon are out of contact with the stem 372, the spring 362 will always force the valve member 360 into sealing engagement with the frustoconical seating surface 354.

Further, the spring forces of each pilot spring 362 and 396 are very much less than the spring force of spring 330 which normally biases pin 320 outwardly away from the pilot valve 350. By using springs 362 and 396 which have a combined spring force very much less than the spring 330, the pilot valve 350 is effectively opened by movement of pin 320 when the force required to move sensing arm 311 and pin 320 is substantially equal to the spring force of the spring 330. The additional force required to overcome the small pilot valve springs 362 and 396 would be so small compared to the spring force of spring 330 that the tension level setting for the tool is effectively set by adjustment of only the main biasing spring 330.

THE PNEUMATIC CONTROL INSTRUMENTALITIES

The Valve Mechanism and Valve Porting

Figure 9:
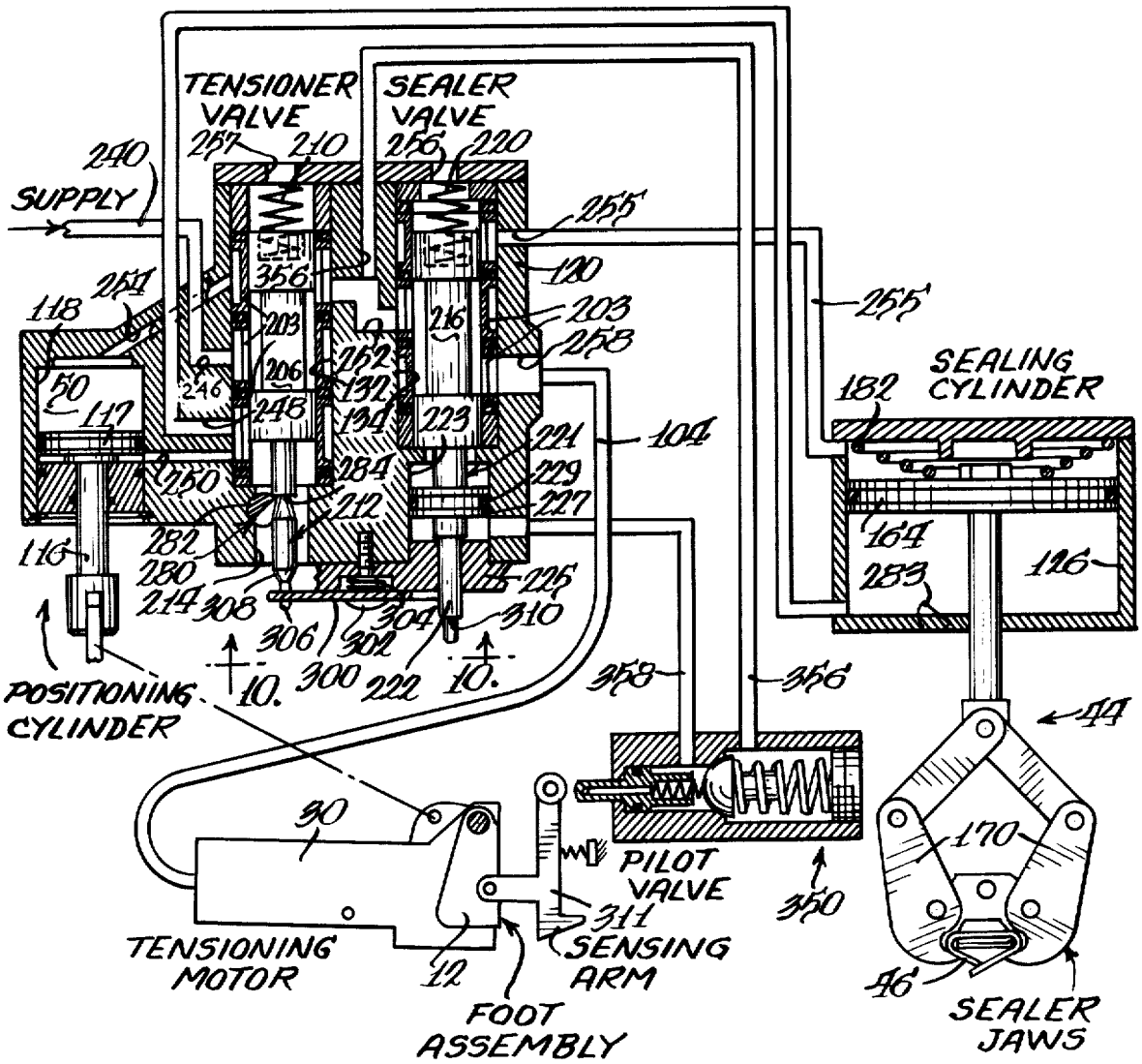
FIG. 9 is a diagram similar to FIG. 6, but showing the mechanisms in the positions assumed during the tensioning sequence.
Figure 11:
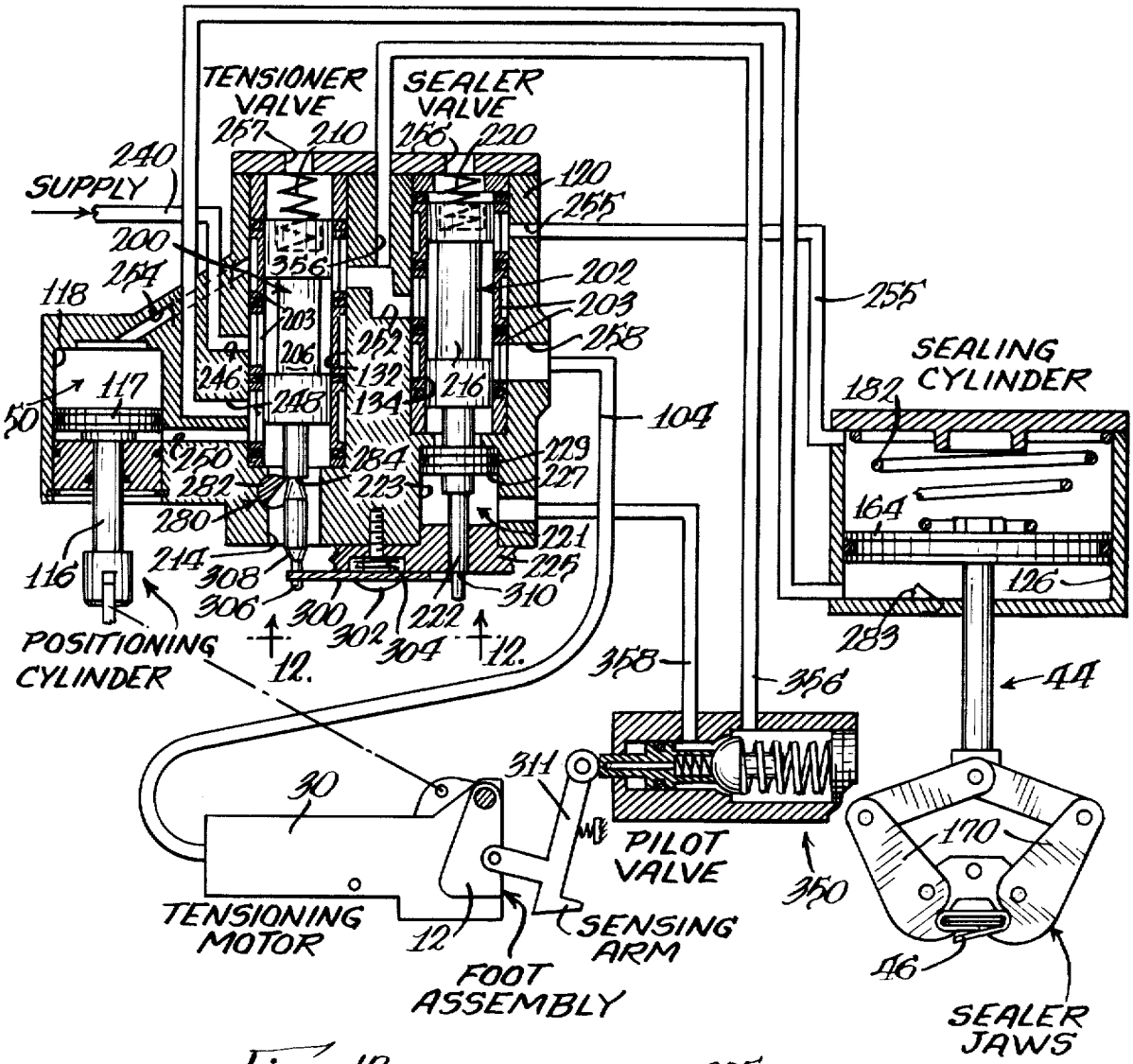
FIG. 11 is a diagram similar to FIG. 9, but showing the mechanism in the positions assumed during the sealing sequence.

Briefly, the operation of the pneumatic strapping tool 10 is effected under the control of two valve assemblies 200 and 202 that are disposed in the previously mentioned valve chambers 132 and 134, respectively (FIGS. 6, 9, and 11). The initial actuation of the valve assembly 200 is effected under the control of the previously mentioned lever 24.

Figure 7:
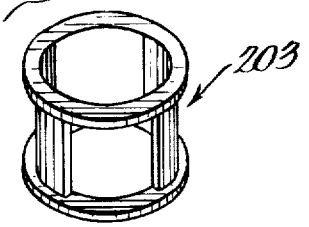
FIG. 7 is a view of a typical valve cage provided in both the tensioner valve and in the sealer valve.

The valves 200 and 202 are spool-type valves which include, within their respective valve chambers, three valve cages 203 (one cage 203 shown greatly enlarged in FIG. 7), disposed in end-to-end alignment. Each cage 203 is of a conventional design comprising an overall generally cylindrical configuration with a plurality of flow passages permitting pressurized air to flow from the interior of the cage to the exterior of the cage within the valve chamber in which it is mounted.

Valve assembly 200 has a valve body 206 which is vertically slidable in the valve cages 203 and is normally urged by means of a spring 210 to the lowered position in which it is shown in FIG. 6, after air has been applied to the tool 10 but before the tool is actuated to begin the tensioning sequence. The valve body 206 is formed with the depending valve stem 212 which projects outwardly of housing 120 through an exhaust port 214 and is designed for engagement with lever 24, which is pivotably mounted about pin 25 to lug 26 at the housing bottom wall 140 as best illustrated in FIGS. 1 and 4. When lever 24 is depressed by the tool operator the valve body 206 is forced upwardly.

The valve assembly 202 includes a body 216 which is vertically slidable in the valve cages 203 and is normally urged by means of a spring 220 to the lowered position shown in FIG. 6. A valve stem 221 projects downwardly from the valve body 216 and into a cylindrical chamber 223 defined within housing 120 and closed at the lower end by member 225. A piston 227 is mounted below, but not attached to, stem 221 for reciprocating movement within the cylindrical chamber 223. A suitable O-ring 229 is provided for sealing the piston 227 against the sides of the cylindrical chamber 223. Projecting from the bottom of piston 227 is reduced diameter stem 222 which projects through the end closure member 225 below the housing 120.

As best illustrated in FIG. 1, air is supplied to the tool 10 through a flexible conduit 240 and a quick release fitting 242 carried by an elbow 244 from whence it is supplied to the valve chamber 132 (FIG. 6) through an internal passage 246 provided in housing 120. (For simplicity, the fitting 242 and elbow 244 are not illustrated in FIG. 6, as well as in FIGS. 9 and 11.) It is to be noted at this point that the air passages are diagrammatically illustrated in FIGS. 6, 9 and 11 and these figures are not intended to show the actual physical configuration of the passages in the housing 120.

An internal passage 248 establishes communication between the valve chamber 132 and the cylinder 126 associated with the actuation of the sealer jaws 170. A second internal passage 250 establishes communication between the valve chamber 132 and the positioning piston and cylinder assembly 50, with the passage 250 supplying air below the piston 117 thereof. A third internal passage 252 establishes communication between the valve chambers 132 and 134. A fourth internal passage 254 establishes communication between the valve chamber 132 and the positioning piston and cylinder assembly 50, the passage 254 supplying air above the piston 117 thereof. A fifth internal passage 255 establishes communication between the valve chamber 134 and the cylinder 126 above piston 164. The upstream side of the pilot valve 350 is connected through the previously mentioned passage 356 to the passage 252 which connects the valve chambers 132 and 134. The outlet side of the pilot valve 350 is connected through the previously described passage 358 to the underside of piston 227 in the cylindrical chamber 223 of the second valve 202. An exhaust passage 256 connects the portion of the valve chamber 134 above the body 216 to the atmosphere and an exhaust passage 257 similarly connects the portion of the valve chamber 132 above the body 206 to atmosphere. Finally, the previously mentioned flexible air line 104 from air motor 30 is connected through the elbow fitting 102 (FIG. 5) to an internal passage 258 leading to the valve chamber 134. (For simplicity, the release fitting 242 and elbow 244 are not illustrated in FIGS. 6, 9, and 11.)

The Valve Stem Latching Device

Figure 8:
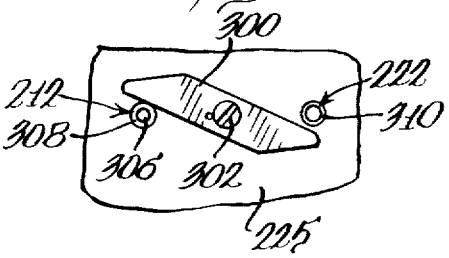
FIG. 8 is a bottom view taken generally along the plane 8—8 in FIG. 6 to illustrate the latching mechanism for the sealer valve in the unlatched position.

As best seen in FIGS. 6 and 8, means are provided for latching the valve stem 212 in its elevated position after initial raising of the stem by the lever 24. This means comprises a latch shaft 280 having a first half-moon extension 282 designed for latching engagement with shoulder 284 provided on the valve stem 212, such an engagement taking place when the valve stem is initially moved to its raised position as illustrated in FIG. 9 at the beginning of the tensioning sequence.

The latch shaft 280 is a rod-like member having the half-moon shaped portion 282 extending the first half of its length and having for the second half of its length a second half-moon portion 283 projecting into cylinder 126 adjacent the bottom wall 140 of the housing 120 and in the path of the movement of piston 164. The second portion 283 is rotated on the longitudinal axis of the rod 280, about 90 degrees out of phase with the first half-moon portion 282. The shaft 280 is yieldingly biased by a suitable spring (not illustrated) into the latching position. The second half-moon shaped portion 283 of the shaft 280 will thus assume a position so that at such time as the piston 164 has fully descended in the cylinder 126, it will be engaged by the underneath side of the piston 164 and the latch shaft 280 rotated against the action of the spring to the valve stem-releasing position. A manually operable trip finger 294 (FIG. 5) is provided on the outwardly projecting portion of the latch shaft 280 and may be employed to release the latch valve stem 212 at such time as a jamming or other malfunctioning of the strapping tool may take place.

The Valve Stem Interlock

With reference to FIGS. 6, 8, 9, 10, 11, and 12, an interlock connection or second latching means between the valve stems 212 and 222 is provided whereby, upon movement of the valve stem 222 to its raised position in a manner to be described hereinafter, the stem 222 will become effectively latched in such position and will remain thus latched until such time as the previously raised valve stem 212 is released by the half-moon extension 282 on the latch shaft 280. Accordingly, a latch arm 300 is pivoted for swinging movement in a horizontal plane about the vertical axis of a retaining bolt 302 and is disposed substantially midway between the valve stems 212 and 222, the arm underlying the housing 120.

A spring 304 biases the arm 300 into cooperating engagement with the valve stem 212, the effective diameter of the latter stem at its point of contact with the latch arm 300 determining the position of the arm. The valve stem 212 is formed with a reduced section 306 at its extreme lower end and this reduced section 306 is connected to the main body portion of the valve body 206 by a frustoconical section 308.

Figure 10:
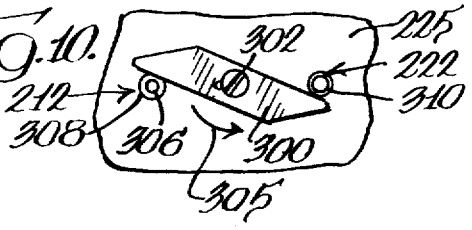
FIG. 10 is a bottom view taken generally along the plane 10—10 in FIG. 9 and similar to FIG. 8 but showing the latching mechanism for the sealer valve pivoted against sealer valve stem.
Figure 12:
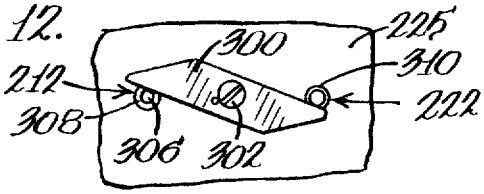
FIG. 12 is a bottom view taken generally along the plane 12—12 in FIG. 11 and similar to FIG. 8 but showing the latching mechanism for the sealer valve in the latched position.

As best illustrated in FIG. 8, when the valve stem 212 is in its fully lowered position, the adjacent end region of the latch arm 300 bears against the main body portion of the valve stem 212 while the opposite end region of the arm is maintained clear of the valve stem 222. As best illustrated in FIGS. 9 and 10, when the valve stem 212 is in its raised position, the adjacent end of the latch arm 300 moves inwardly toward, but does not contact, the reduced section 306 because the opposite end region of the arm 300 is biased against the valve stem 222 (in the direction of arrow 305 in FIG. 10) under the influence of the spring 304. As best illustrated in FIGS. 11 and 12, when the piston 227 is raised and carries with it stem 222, the latch arm 300 can move beneath a downwardly facing annular shoulder 310 on the valve stem 222 and thus latch the latter stem in the raised position. At such time the the valve stem 212 is released by the latching extension 282 of latch shaft 280 as previously described, the adjacent end of the latching lever 300 will ride outwardly on the frustoconical section 308 of the valve stem 212 during descent of the latter and return it to its position on the main body portion of the valve stem, thus causing the opposite end of the lever 300 to move away from valve stem 222 and release the latter for downward movement under the influence of the spring 220.

Operation of the Strapping Tool

Before describing the operation of the strapping tool 10 in detail, it is deemed pertinent in the interest of clarity to ascribe functional designations to the two control valve assemblies 200 and 202 which have been applied in the form of labeling in FIGS. 6, 9, and 11. The valve assembly 200 has been designated as the tensioner valve inasmuch as its operation controls the operation of the tensioning motor 30. The valve assembly 202 has been designated as the sealer valve inasmuch as its operation controls the application of pneumatic pressure to the upper end of cylinder 126 for the purpose of forcibly driving the piston 164 downwardly to effect the seal crimping operation.

In the operation of the strapping tool, the tool may be suspended from an overhead hoist or adjustable tool balancing support by means of the suspension rod 20 (FIGS. 1 and 5), the rod 20 being designed to maintain the tools at various universal inclinations other than the vertical position in which it is shown in the drawings. An appreciable amount of the total weight of the tool is thus supported to the end that the danger of damaging the article A undergoing strapping will be minimized.

The tool 10 is manipulated to bring the foot anvil 60 and nose 314 to a position wherein its underneath surface bears against the article A as shown in FIG. 1. Prior to such manipulation of the tool 10, the strapping S is passed around the article A and fed through a seal 46 in the manner previously described with reference to FIG. 1 so that the free end 43 region of the strap is doubled over rearwardly and underlies the seal 46 so that this portion of the strap is anchored in position between the seal 46 and the article A during the tensioning operation. When the tool is brought into position against the article A, the guide channel 62 in the nose 314 and anvil 60 becomes centered over the strap. The trailing portion 40 of the strap is caused to pass over the nose 314 and foot anvil 60 between strap guides 92 and 96 as previously described and from thence the strapping S passes to a suitable source of strap such as a strap coil or the like. Manual tensioning may be resorted to until all looseness in the encircling strap has been taken up and the strap assumes its approximate final position with respect to the article.

It will be understood that prior to the application of the tool to the article A, the flexible conduit 240 will have been applied to the quick release fitting 242 so that the strapping tool will be supplied with air, the air entering the valve chamber 132 through the passage 246 (FIG. 6) and flowing through the valve cages 203 to the passage 248 from whence it enters the cylinder 126 in the lower region thereof and maintains the piston 164 in its uppermost position against the action of the spring 182. With the piston 164 thus elevated, the seal crimping unit 44 assumes the position in which it is shown in FIG. 1 with the crimping jaws 170 in their fully open position. At the same time, air leaves chamber 132 through the passage 250 and enters the positioning piston and cylinder assembly 50 below the piston 117, thus elevating the piston 117 and causing the tensioning assembly 14 to assume the position wherein it is shown in FIG. 1 with its axis coincident with the line X—X. At this time, the tensioning wheel 34 will be out of effective engagement with the anvil 60 to facilitate loading of the tool in the manner previously described.

After the strapping tool has been loaded with the strap S, the lever 24 is depressed by the tool operator so that the lever pushes the tensioning valve stem 212 upwardly to raise the same. The movement of the stem 212 causes the valve body 206 to become elevated (FIG. 9) and the half-moon extension 282 of the latch shaft 280 will engage the shoulder 284 on the valve stem 212 and maintain the valve body 206 in its raised position. As the valve stem 212 thus moves upwardly, the adjacent end of the latch arm 300 will ride inwardly on the frustoconical section 308 of the valve stem and then swing in toward the reduced section 306. The opposite end of the arm 300 will engage the valve stem 222 and yieldingly bear thereagainst under the influence of the spring 304 whereupon the arm 300 has the position illustrated in FIGS. 9 and 10.

With the valve body 206 thus raised, (FIG. 9), the passages 248 and 250 will thus exhaust to atmosphere through the exhaust bore 214 around the stem 212. At the same time air will flow through the passage 254 and enter the positioning piston and cylinder assembly 50 above the piston 117 to force the latter downwardly and cause a shifting of the tensioning unit 14 bodily as a unit so that its axis will coincide with the line Y—Y of FIG. 1, thus bringing the tensioning wheel 34 into cooperation with the anvil 60 for strap engaging purposes. Air also will at this time flow through the passage 252, enter the valve chamber 134, and flow through the passage 258 and flexible line 104 to the tensioning motor 30. The tensioning motor 30 is thus energized to cause rotation of the tension wheel 34 in a tensioning direction to draw the strap S about the article A in the usual manner to strap tensioning.

Inasmuch as at this time the passage 248 from cylinder 126 is in communication with the atmosphere through the exhaust port 214 around stem 212, the spring 182 will force the piston 164 downwardly in the cylinder 126 to close the crimping jaws 170 about the seal 46 which has been previously positioned about the overlapping portions of the strap, as shown in FIG. 9. The force of the spring 182 is insufficient to crush or crimp the seal 46 and is sufficient merely to pre-position the seal and hold it in register with the shearing unit 48 (visible only in FIG. 1) which is now moved into operative register in cooperation with the sealing unit 44 as previously described. This seal engaging or "pre-wrap" condition is maintained during the entire tensioning operation and until such time as the jaw members 170 are actuated to crimp the seal as will now be described.

It is to be noted at this point that during the movement of the tensioning assembly 14 from its raised to its lowered position as previously described, the tension sensing arm 311 is moved to the generally vertical position illustrated in FIG. 4 with the contact wheel 382 on pin 320 disposed adjacent the end of the pilot valve steam 372. As the tension in the loop increases, the foot assembly 12 and nose 314 are urged against the seal 46 under the reaction of the tension in the strap being transmitted through the tension wheel 34 to the foot assembly 12 via the link 10 and shaft 18. Since the tension sensing arm 311 can pivot about the shaft 313, the strap tension reaction force urging the nose 314 against the seal 46 tends to pivot the arm 311 in a clockwise direction as viewed in FIG. 4. This moves the pin 320 and the piston 334 against the spring 330. When the tension in the strap loop reaches a predetermined level, equal to the force required to overcome the preset bias of spring 330, the tension-sensing arm 311 pivots clockwise to move the contact wheel against the stem member 372 of the pilot valve 350 and to thereby open the pilot valve in the manner previously described in detail.

When the pilot valve 350 opens in response to attainment of the predetermined loop tension, supply air passes from inlet passage 356 through the pilot valve 350 and is directed by passage 358 to the underside of piston 227. Under the influence of the pressurized air beneath the piston 227, the sealer valve body 216 is raised to its uppermost position as illustrated in FIG. 11. At this point the adjacent end of latch arm 300 will move beneath the shoulder 310 on the valve stem 322 and latch the stem and valve body in an elevated position against the action of spring 220.

With the valve body 216 thus raised, air issuing from the passage 252 can still continue to flow through the passage 258 and conduit 104 to the tensioning air motor 30. Also, the raised position of the sealer valve 202 now permits air from passage 252 to flow through the passage 255 and enter the cylinder 126 above the piston 164, thus driving the latter downwardly and effecting the seal crimping operation as the crimping jaws 170 forcibly close upon the seal 46. This downward power stroke of the piston 164 occurs very rapidly and substantially as soon as the sealer valve 202 has been raised to its elevated position. Thus, the seal 46 is crimped before the tensioning motor 30 can effectively apply a greater tension to the strap loop than the tension corresponding to the setting of the biasing spring 330.

The downward power stroke of the piston 164 not only effects the seal crimping operation but also effects operation of the seal shearing unit 48 in a conventional manner as explained in detail in the aforementioned Plunkett patent.

At such time as the piston 164 reaches the bottom of the power stroke, the underneath side of the piston 164 engages the second half-moon extension 283 on the latch shaft 280, thus rotating the shaft 280 and causing the first half-moon extension 282 to release the shoulder 284 on the valve stem 212 and allowing the valve body 206 and the stem 212 to move downwardly under the influence of the spring 210. Such downward movement of the stem 212 causes the adjacent end of the latch arm 300 to ride outwardly on the frustoconical section 308 of the valve stem 212, thus withdrawing the opposite end of the latch arm 300 from the valve stem 222 and allowing this latter stem, together with the associated valve body 216, to move downwardly.

As the tensioner valve body 206 moves downwardly, any residual air may be forced outwardly from the bottom of chamber 132 through the exhaust port 214 around the stem 212. When the tensioner valve body 206 returns to its downwardmost position, the main air supply through passage 246 is blocked from entering the passage 252 which supplies the sealer valve 202 with air. Thus, the air supply to the tensioner motor 30 is terminated. The pressure within passage 252 and valve chamber 134 of the sealer valve 202 is thus exhausted through the passage 258 and conduit 104 to the tension motor and out through the usual motor vane exhaust ports in the tension motor. The air within chamber 134 may also exhaust, along with any residual air in passage 252, through the top of tensioner valve chamber 132 and out its exhaust port 257 above body 206.

With the tensioner valve 200 in the lowered position illustrated in FIG. 6, the air supply to the top of the positioning piston and cylinder actuator 50 through passage 254 is also terminated and air on the top of the piston 117 of that assembly 50 is exhausted through passage 254 into the top portion of tensioner valve chamber 132 and out the exhaust port 257.

With the tensioner valve in the downwardmost position, the air supply is then fed through passage 250 to the bottom of the positioning piston and cylinder assembly 50 to force the piston 117 thereof to its upwardmost position illustrated in FIG. 6. This raises the tensioning assembly 14 to lift the tension wheel 34 off of the strap and orients the sealing assembly 16 such that the sealer jaws 170 assume the open seal-releasing position as illustrated in FIG. 1.

As the tensioning assembly 14 is pivoted upwardly away from the strap, the sealer assembly 16, being pivoted outwardly as illustrated in FIG. 1, carries the housing 326 outwardly away from pin 320 (FIG. 3) which is biased to the rearward end of the housing slots 342 and 344 in members 346 and 348, respectively. Thus, the contact wheel 382 is moved out of engagement with, and away from, the pilot valve stem 372. With reference to FIG. 6, it can be seen when the contact wheel 382 is out of contact with the pilot valve stem 372, the stem 372 is biased to the end of the pilot valve chamber 352 so that the first portion 370 of member 366 has moved away from the valve member 400 to permit air flow through the passage 392 to atmosphere. In this manner, the underside of piston 227 in the sealer valve 202 is exhausted to permit the sealer valve body 216 to be forced to its downwardmost position by the spring 220. Exhausting of the underside of piston 227 in the sealer valve 202 (and of the pilot valve chamber 352 downstream of the valve member 400) ensures that the valve member 400 will be closed tight against the valve seat 354.

With the sealer valve 202 in its lowered position (FIG. 6), the cylinder 126 above piston 264 is exhausted through passage 255 to the atmosphere through the valve chamber 134 and from thence through the exhaust passage 256 above valve body 216. At the same time, air under full line pressure is restored to cylinder 126 below the piston 164 from the port 248 by means of tensioner valve 206 being in the lowered position as previously described, thus forcing the piston 164 upwardly against the action of the spring 182. The various strapping tool instrumentalities are thus restored to their original position as shown in FIG. 1 preparatory to the next strapping operation.

From the foregoing, it will be observed that numerous variations and modifications may be effected without departing from the true spirit and scope of the novel concept of the invention. It is to be understood that no limitation with respect to the specific apparatus illustrated herein is intended or should be inferred. It is, of course, intended to cover by the appended claims all such modifications as fall within the scope of the claims.

It is claimed:

1. A strapping tool for first tensioning a strap looped around an article with both overlapping strap portions threaded through a crimpable or notchable seal and with one strap free end doubled over and restrained between the seal and the article during tensioning and for then crimping or notching the seal around the tensioned overlapping strap portions, said tool comprising:

a. a frame adapted to rest upon said article;

b. an arm pivotally mounted on said frame for pivoting movement in a first direction and in a second, opposite direction;

c. an abutment means on said arm for engaging said seal during tensioning;

d. means for biasing said arm in said first direction during tensioning;

e. tensioning means mounted on said frame for engaging one of the overlapping portions of the strap and for pulling the same through the seal to tension the loop whereby the tension reaction urges said frame relative to the seal to force said arm abutment means against the seal and, at a predetermined tension level, causes said arm to overcome said biasing means and pivot relative to said frame in said second direction;

f. means for crimping or notching said seal around the overlapping portions of the strap; and g. control means responsive to the pivoting movement of said arm in said second direction for operating said crimping or notching means.

2. The strapping tool in accordance with claim 1 in which said crimping or notching means is an air operated mechanism.

3. The strapping tool in accordance with claim 2 in which said control means includes a pilot valve means operable in response to the pivoting movement of said arm in said second direction when said biasing means is overcome for supplying air to operate said crimping or notching means.

4. The strapping tool in accordance with claim 3 in which said pilot valve means includes (1) a housing; (2) a valve member movable in said housing between a closed position blocking air flow through said pilot valve means and an open position permitting air flow through said pilot valve means; (3) an engagement member having a first end slidably received in said housing adjacent said valve member and a first end adapted to be engaged by said arm; and (4) a spring disposed in said housing and urging said valve member towards said first end of said engagement member and to said closed position, whereby, when said predetermined tension level is reached during tensioning, said arm overcomes said arm biasing means and moves said engagement member against said valve member to overcome the urging of said spring and move said valve member to open said pilot valve for supplying air to operate said crimping or notching means.

5. In a pneumatically operable strapping tool for tensioning a loop of strap about an article, said loop having overlapping free end and trailing end portions threaded through a crimpable or notchable seal and with the strap free end doubled over and restrained between said seal and said article during tensioning, and for thereafter crimping or notching the seal about said overlapping portions, a frame adapted to rest upon the article; a sealing assembly supported on the frame and including (1) a pair of seal-positioning and seal-crimping or notching jaws movable from an open seal-releasing position through an intermediate seal-retaining position to a fully closed seal-crimping or notching position and vice versa, (2) a cylinder supported on the sealing assembly, (3) a piston slidable in said cylinder and operatively connected to said sealing jaws, said piston being movable between a retracted position wherein said jaws are in their seal-releasing position and a fully advanced position wherein the jaws are in their seal-crimping or notching position, and (4) spring means yieldingly biasing said piston toward its fully advanced position to cause said jaws to engage the seal under pressure sufficient only to engage and maintain the seal position with respect to the tensioning mechanism but insufficient to crimp or notch the seal; an arm pivotably mounted on said frame for pivoting movement in a first direction and in a second, opposite direction; arm biasing means for biasing said arm in said first direction; an abutment means on said arm for engaging said seal during tensioning; pilot valve means operable for supplying air to operate said cylinder to augment the action of said spring biasing means and force the piston to its fully advanced position; a movable engagement member adapted to be engaged by said arm and connected to operate said pilot valve means; tensioning means mounted on said frame for engaging the overlapping trailing portion of the strap and for pulling the same through the seal to tension the loop whereby the tension reaction urges said frame relative to the seal to force said arm abutment means against the seal and, at a predetermined level, causes said arm to overcome said arm biasing means to operate said pilot valve means for supplying air to operate said cylinder.

6. In a pneumatically operable strapping tool for tensioning a loop of strap about an article, said loop having overlapping free end and trailing end portions threaded through a crimpable or notchable seal and with the strap free end doubled over and restrained between the seal and the article during tensioning, and for thereafter crimping or notching the seal about said overlapping portions; said tool having a frame adapted to rest upon the article; tensioning means mounted on said frame for engaging the overlapping trailing portion of the strap and for pulling the same through the seal to tension the loop; a sealing assembly supported on the frame and including (1) a pair of seal-positioning and seal-crimping or notching jaws movable from an open seal-releasing position through an intermediate seal-retaining position to a fully closed seal-crimping or notching position and vice versa, (2) a sealer cylinder supported on the sealing assembly, (3) a sealer piston slidable in said sealer cylinder and operatively connected to said sealing jaws, said sealer piston being movable between a retracted position wherein said jaws are in their seal-releasing position and a fully advanced position wherein the jaws are in their seal-crimping or notching position, and (4) sealer spring means yieldingly biasing said sealer piston toward its fully advanced position to cause said jaws to engage the seal under pressure sufficient only to engage and maintain the seal position with respect to the tensioning mechanism but insufficient to crimp or notch the seal; said tool also having pneumatically operable sealing jaws control valve means including (1) a valve body movable from a first closed position to a second open position to admit air to one end of said sealer cylinder to augment the action of said sealer spring means and force said sealer piston to its fully advanced position, and (2) a valve body spring means yieldingly urging said valve body to its first closed position; latch means automatically effective upon movement of said valve body to its second position to latch the same in such position; means automatically operable upon movement of said sealer piston to its fully advanced position to release said latch means for return of said valve body to its first closed position under the influence of said valve body spring means the improvement comprising:

an arm pivotably mounted on said frame for pivoting movement in a first direction and in a second, opposite direction; arm biasing means for biasing said arm in said first direction during tensioning; an abutment means on said arm for engaging said seal during tensioning; pilot valve means operable for supplying air to said sealing jaws control valve means to move said valve body from said first position to said second position; a movable engagement member adapted to be engaged by said arm and connected to operate said pilot valve means whereby the tension reaction urges said frame relative to the seal to force said arm abutment means against the seal and, at a predetermined tension level, causes said arm to overcome said arm biasing means to operate said pilot valve means.

7. In a pneumatically operable strapping tool for tensioning a loop of strap about an article, said loop having overlapping free end and trailing portions threaded through a crimpable or notchable seal and with the strap free end doubled over and restrained between the seal and the article during tensioning, and for thereafter crimping or notching said seal about the overlapping portions; a frame adapted to rest upon the article; a sealing assembly pivotably supported on the frame and including a pair of seal-retaining and seal-crimping or notching jaws movable from an open seal-releasing position, through an intermediate position wherein the jaws straddle and engage the seal in a holding relationship, to a fully closed seal-crimping or notching position and vice versa, said sealing assembly being movable between a retracted position wherein said jaws are out of register with the seal and an advanced position wherein the jaws are in registry with the seal; a first piston and cylinder unit effective between the sealing assembly and the frame to move the sealing assembly between its retracted and advanced positions; a second piston and cylinder unit carried by the sealing assembly and effective to actuate said jaws; sealer spring means normally biasing said second piston and cylinder unit to move said jaws toward their intermediate position; a manually operable first control valve and a pneumatically actuated second control valve, said first control valve effective in a first position to supply air to said first and second piston and cylinder units to maintain said sealing assembly in its retracted position and to maintain the jaws in their open position against the action of said spring means, said first control valve effective in a second position to supply air to said second control valve and to said first and second piston and cylinder units to move the sealing assembly from its retracted to its advanced position and to relieve said second piston and cylinder unit of air and cause said jaws to move to their intermediate seal-retaining position under the influence of the sealer spring means, said second control valve having a first, closed position and a second, open position to admit air to said second piston and cylinder unit to move said jaws to their fully closed seal-crimping or notching position; an arm pivotably mounted on said frame for pivoting movement in a first direction and in a second, opposite direction; an abutment means on said arm for engaging said seal during tensioning; pilot valve means operable for supplying air to said second control valve to actuate it from said first position to said second position; a movable engagement member adapted to be engaged by said arm and connected to operate said pilot valve means; means for biasing said arm during tensioning in said first direction; tensioning means mounted on said frame for engaging the overlapping trailing portion of the strap and for pulling the same through the seal to tension the loop whereby the tension reaction urges said frame relative to the seal to force said arm abutment means against the seal and, at a predetermined tension level, causes said arm to overcome said biasing means to operate said pilot valve means.

8. The strapping tool in accordance with claim 7 in which said first control valve has a first valve body movable between (1) a first position to supply air to said first and second piston and cylinder unit to maintain said sealing assembly in its retracted position and to maintain the jaws in their open position against the action of said spring means, and (2) a second position to supply air to said second control valve and to said first and second piston and cylinder units to move the sealing assembly from its retracted to its advanced position and to relieve said second piston and cylinder unit of air and cause said jaws to move to their intermediate seal-retaining position under the influence of the spring means; in which said first control valve further includes (1) first valve body spring means yieldingly urging said first valve body to its first position and (2) first latch means automatically effective upon movement of said first valve body to its second position to latch the same in such position; said tool further including means automatically operable upon movement of said jaws to the fully closed seal-crimping or notching position to release said first latch means for return of said first valve body to its first position under the influence of said first valve body spring means; in which said second control valve has a second valve body movable between (1) a first closed position and (2) a second open position to admit air to one end of said second piston and cylinder unit to augment the action of said sealer spring means and actuate said second piston and cylinder unit to move said jaws to their fully closed seal-crimping or notching position; in which said second control valve further includes a second valve body spring means yieldingly urging said second valve body to its first, closed position; in which said tool further includes second latch means responsive to said movement of said first valve body to said second position to (1) automatically latch said second valve body to its second position upon movement of said second valve body to its second position and to (2) automatically unlatch said second valve body when said first valve body in unlatched and is in its first position.

9. The strapping tool in accordance with claim 7 in which said tensioning means is pneumatically operated and in which said second control valve is effective in said first position to supply air to said tensioning means.

10. The strapping tool in accordance with claim 7 in which said second control valve includes a control valve cylinder and a control valve body piston slidably received in said control valve cylinder and in which said pilot valve means is connected to pass air from said first control valve to said second control valve cylinder for moving said second control valve to said second position when both (1) said first control valve is in said second position and (2) said pilot valve means is operated by said arm.

* * * * *